United States Patent [19]

Kopper

[11] Patent Number: 4,930,485

[45] Date of Patent: Jun. 5, 1990

[54] ARCHERY BOW SYSTEM HAVING A CENTER NOCK AND STRING DRAWING APPARATUS

[75] Inventor: Hermann Kopper, Miami, Fla.

[73] Assignee: Kopher Precision Instruments, Inc., Miami, Fla.

[21] Appl. No.: 405,234

[22] Filed: Sep. 11, 1989

[51] Int. Cl.[5] ..... F41B 5/00

[52] U.S. Cl. ..... 124/91; 124/23.1; 124/35.2

[58] Field of Search ..... 124/23 R, 24 R, 35 A, 124/90, 91

[56] References Cited

U.S. PATENT DOCUMENTS

| | | | |
|---|---|---|---|
| 2,905,166 | 9/1959 | Niemeyer . | |
| 3,847,133 | 11/1974 | Awiszus . | |
| 3,886,924 | 6/1975 | Chesnick | 124/23 R |
| 4,086,904 | 5/1978 | Suski et al. | 124/90 |
| 4,621,607 | 11/1985 | Busch | 124/35 A |
| 4,625,705 | 12/1986 | Willits | 124/35 A |
| 4,691,683 | 9/1987 | Peck | 124/35 A |

OTHER PUBLICATIONS

"How to Tie the Loop", Bow and Arrow Magazine, Apr. 1986, p. 46.

*Primary Examiner*—Randolph A. Reese
*Assistant Examiner*—John Ricci
*Attorney, Agent, or Firm*—Oltman and Flynn

[57] ABSTRACT

An archery bow system includes a bow, a bow string attached to the bow, a center nock attached to the bow string having a half loop with two ends attached to the bow string, and a hand held bow string drawing device which includes a releasable draw pin that engages with the half loop, and a trigger connected with the draw pin to release the bow string upon operation of the trigger.

7 Claims, 1 Drawing Sheet

ARCHERY BOW SYSTEM HAVING A CENTER NOCK AND STRING DRAWING APPARATUS

The invention relates to archery bows and more particularly to a bow having a bow string equipped with a loop-shaped center nock attached to the bow string and bow string drawing apparatus having a releasable draw pin for engagement with said loop-shaped nock.

BACKGROUND AND PRIOR ART

In the sport of archery it is well known to provide a so-called nock at the rear end of the arrow, which, in essence is a slot adapted to receive the bow string during the draw. It is also well known that in order to perform a good aim of the arrow. The nock must be placed on the bow string at a point close to the center of the string and that said point must also be aligned horizontally with the point at which the arrow is supported at the center of the bow. In order to attain such alignment it is known to provide a so-called center nock attached to the center of the bow string, which engages the rear end of the arrow, while it is being driven by the bow string toward the target.

It is also known to provide various forms of handheld gripping and drawing devices that enable an archer to apply a strong pull to the bow string, rather than having to grip the end of the arrow with two fingers.

U.S. Pat. No. 2,905,166 shows a center nock shaped to fit on a bow string and to drive the rear end of the arrow. While that arrangement does provide proper positioning of the arrow on the string, it does not provided any means for gripping the bow string with other then the fingers. U.S. Pat. No. 4,086,904 shows a drawing device for gripping the bow string and a center nock attached to the bow string for driving the arrow. That system has the disadvantages that the drawing device grips the bow string at a point below the center nock with the result that upon release an uneven vibration is set up in the string which is detrimental to good aim, and furthermore after many repeated cycles of gripping and releasing the string, it gradually becomes frayed and eventually breaks at the point of gripping.

It is accordingly an object of the instant invention to provide a center nock for an archery bow that overcomes the drawbacks of the known art and provides that the string be drawn directly of the center, and that fraying of the bow string be avoided.

SUMMARY OF THE INVENTION

According to the stated objective, there is provided an archery bow system which includes a bow, a bow string attached to the bow; a center nock attached to the bow string, wherein the knock form a half loop with two ends, with each end attached to the bow string, and a hand held bowstring drawing device which includes a releasable draw pin that engages with the half loop and a trigger connected with the draw pin so as to release the bow string upon operation of the trigger.

According to a further feature, the archery bow system according to the invention is arranged such that the ends of the half loop each forms an eyelet for receiving the bow string, and wherein each eyelet has a sleeve inside the eyelet for securing the nock to the bow string.

According to a still further feature, there is provided an archery bow system wherein the eyelet includes a split serving to open the eyelet, and has a closing or clamping arrangement for snugly closing said split, and wherein the closing means include a threaded screw or rivet or clasp for securing the two ends of the split in the eyelet.

According to another feature, there is provided an archery bow system as described above, wherein the handheld drawing device includes an arcuate rear facing edge that fits inside a palm of a hand and a scalloped front edge with indentations for receiving fingers of the hand drawing the string, and wherein the trigger has an upward facing outer end to be operated with a thumb of the drawing hand, and linkage connecting the trigger with the releasable draw pin in order to release the draw pin in response to thumb pressure applied to the upper outer end of the trigger.

In addition, there is provided an archery bow system according to the invention wherein the sleeve is made of a flexible elastic material.

Further objects and advantages of this invention will be apparent from the following detailed description of a presently preferred embodiment which is illustrated schematically in the accompanying drawings.

DESCRIPTION OF THE PREFERRED EMBODIMENTS

Figure 1:
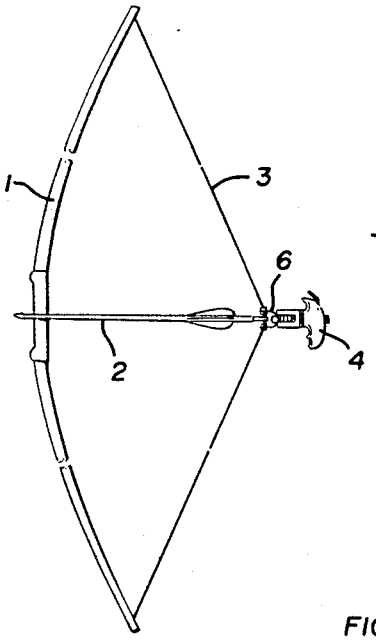
FIG. 1 is an elevational view of the invention showing a bow with a center nock, an arrow, and a drawing device.

FIG. 1 shows a bow 1 of any suitable form with an arrow 2 on the bow, a bow string 3 held in drawn condition by a drawing device 4, which is in engagement with a center nock 6 attached to the bow string 3.

Figure 6:
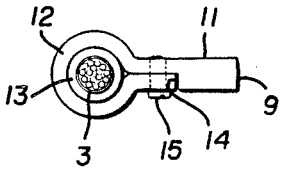
FIG. 6 is a fragmentary detail view of the center nock seen along the line 6—6 of FIG. 5.
Figure 2:
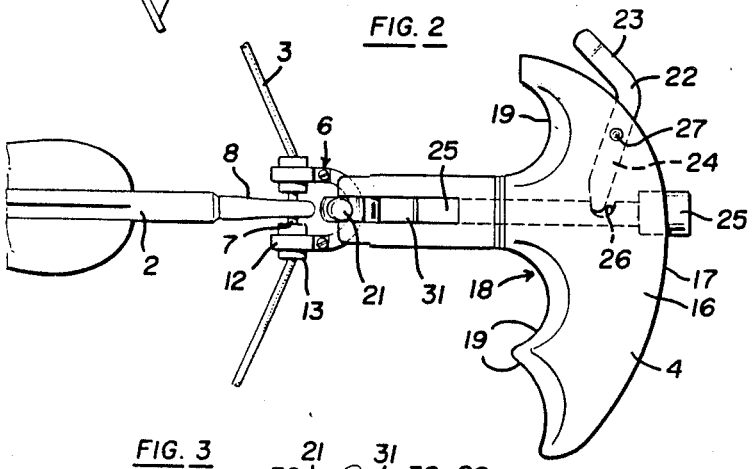
FIG. 2 is an elevational enlarged detail view of the invention showing the center nock and the drawing device, with a drawn bow string.
Figure 5:
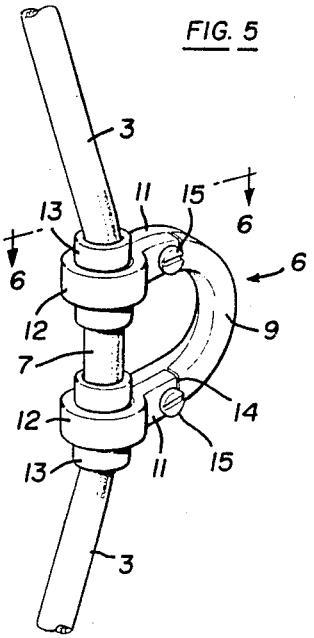
FIG. 5 is a fragmentary enlarged detail perspective view of the center nock attached to a bow string.

FIG. 2 is a side view of the center nock 6 attached to a draw bow string 3, as in FIG. 1, being drawn by the drawing device 4. The arrow 2 has its rear end forked so that it is capable of receiving the center part 7 of the bow string in the fork 8 during the draw. The center nock 6, shown in more detail in FIG. 5, is formed as a half loop with two ends 11. Each end 11 is formed as an eyelet 12, seen more clearly in FIG. 6. The bow string 3 is threaded through the eyelets 12 leaving the center part 7 of the bow string between the eyelets 12. A sleeve 13 of a resilient flexible material such as rubber, leather or the like may advantageously be placed inside the eyelet 12, around the bow string 3, in order to provide a firm grip on the bow string 3.

The eyelet 12 is formed to have a split 14 that enables the eyelet to be bent open in order to admit the sleeve 13 and the bow string 3. After insertion the eyelet is again closed and drawn shut by means of fastener such as a threaded screw, rivet, or the like, 15, which when drawn tightly serves to clamp the eyelet 12 with the sleeve 13 firmly gripping the bow string 3. The details of the drawing device 4 are shown in more detail in FIGS. 2, 3 and 4, of which FIG. 2 shows the drawing device 4 with a hand grip 16 having an arcuate rear edge 17 that fits comfortably inside the palm of a hand, and a scalloped front edge 18 having finger indentations 19 to provide a firm finger grip.

Figure 7:
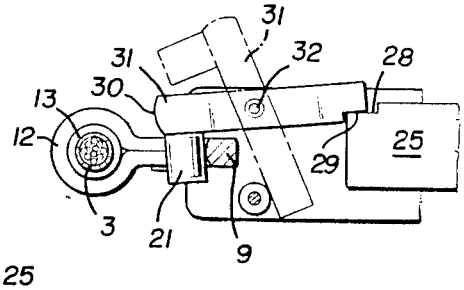
FIG. 7 is a detail fragmentary view of the trigger and draw pin arrangement.

The drawing device has a releasable draw pin 21, which serves to grip the inside of the loop 9 during the drawing motion. A trigger 22 has an upper end 23 extending outward and upward from the drawing device 4 and has a lower end 24 engaging an axially slidable bolt 25 in a notch 26, and is pivotable about a pivot point 27. The bolt 25 has at its inner end a sear 28, matching a sear 29 on a lever 31, pivotally mounted on pivot point 32, and supporting at its distant end 30 the draw pin 21, best seen in FIG. 3 and enlarged in FIG. 7.

Figure 3:
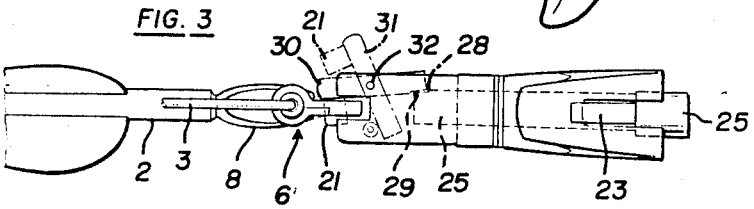
FIG. 3 is a plan view of the invention according to FIG. 2.
Figure 4:
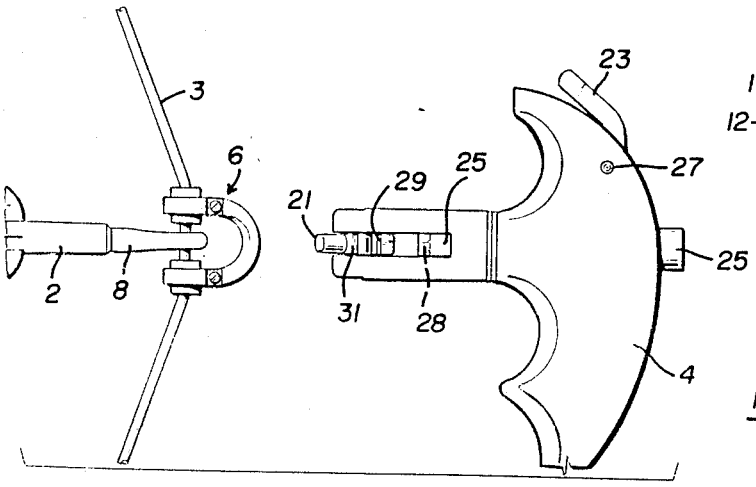
FIG. 4 is an elevational view of the invention according to FIG. 2, immediately after release of the bow string.

Upon depressing the trigger outer end 23 with a thumb, the bolt 25 moves rearward, causing the sears 28, 29 to disengage, allowing the lever 31 to pivot open, as seen in FIG. 3, allowing the draw pin 21 to release the half loop 9 of the center nock 6, and to shoot the arrow 2.

I claim:

1. An archery bow system comprising a bow, a bow string attached to the bow; a center nock attached to the bow string, the center nock forming a half loop having two ends, each end attached to the bow string; and a handheld bowstring drawing device including a releasable draw pin for engagement with said half loop, and a trigger in engagement with said draw pin for releasing the draw pin, said ends of said half loop each forming an eyelet for receiving said bow string, said eyelet including a split for opening said eyelet, and closing means for snugly closing said split.

2. Archery bow system according to claim 1, further including a sleeve inside each eyelet for securing said center nock to said bow string.

3. Archery bow system according to claim 2, wherein said closing means includes a threaded screw for securing said split of said eyelet.

4. Archery bow system according to claim 2 wherein said sleeve is made of a flexible elastic material.

5. Archery bow system according to claim 1, wherein said hand held drawing device includes an arcuate rear edge for fitting inside a palm of a hand and a scalloped front edge for receiving fingers of a hand.

6. Archery bow system according to claim 5, wherein said trigger has an upward facing outer end for engagement with a thumb, and linkage connecting said trigger with said releasable draw pin for releasing the draw pin in response to thumb pressure applied to said outer end of said trigger.

7. Archery bow system according to claim 6, wherein said linkage includes an axially slidable bolt in engagement with said trigger, a pivotable lever with said draw pin disposed thereon and a pair of sears between said bolt and said lever for releasing said releasable draw pin.

* * * * *